United States Patent [19]

Collier

[11] Patent Number: 4,890,386

[45] Date of Patent: Jan. 2, 1990

[54] RECIPROCATING KNIFE APPARATUS

[76] Inventor: Doris B. Collier, Rte. 3, Box 625, Wilson, N.C. 27893

[21] Appl. No.: 230,528

[22] Filed: Aug. 10, 1988

[51] Int. Cl.[4] ..... B26B 29/02

[52] U.S. Cl. ..... 30/136; 30/148; 30/289; 30/322; 30/272.1

[58] Field of Search ..... 30/136, 148, 272 R, 30/258, 289, 136.5, 147–150, 322, 324, 142

[56] References Cited

U.S. PATENT DOCUMENTS

| | | | |
|---|---|---|---|
| 3,376,640 | 4/1968 | Kramer et al. | 30/148 |
| 3,541,693 | 11/1970 | McCullough | 30/136 |
| 3,584,382 | 6/1971 | Breen | 30/136 X |

*Primary Examiner*—Frank T. Yost
*Assistant Examiner*—Y. Lin
*Attorney, Agent, or Firm*—Leon Gilden

[57] ABSTRACT

A reciprocating knife is set forth for use by individuals without or diminished use of a second arm. The knife includes a projecting flange integrally formed outwardly of a forward edge of a handle wherein the flange is provided with a matrix of downwardly depending projections. A telescoping knife blade is nestable within an associated hollow handle and is provided with a slide reciprocatable within a groove of the handle to reciprocate the associated knife point. The flange and projections may thereby secure an item to be cut while the knife blade is reciprocated to effect cutting.

1 Claim, 1 Drawing Sheet

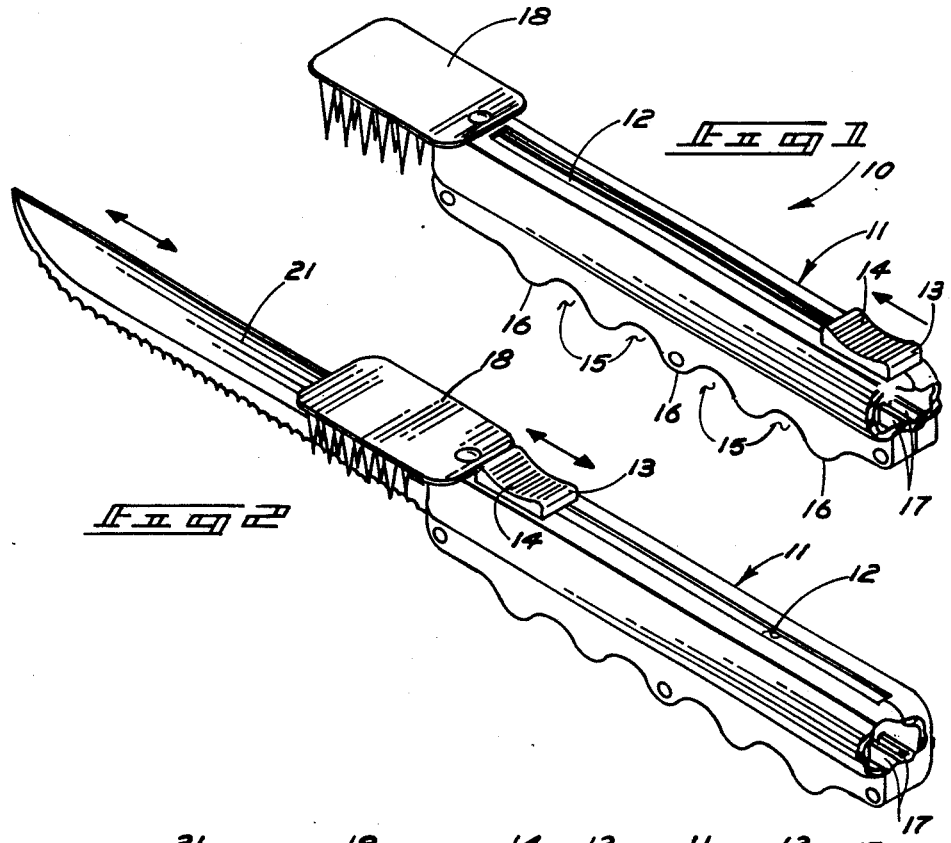
Fig 1
Fig 2
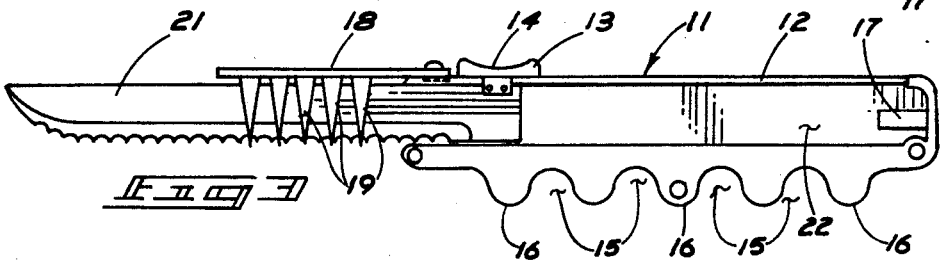
Fig 3
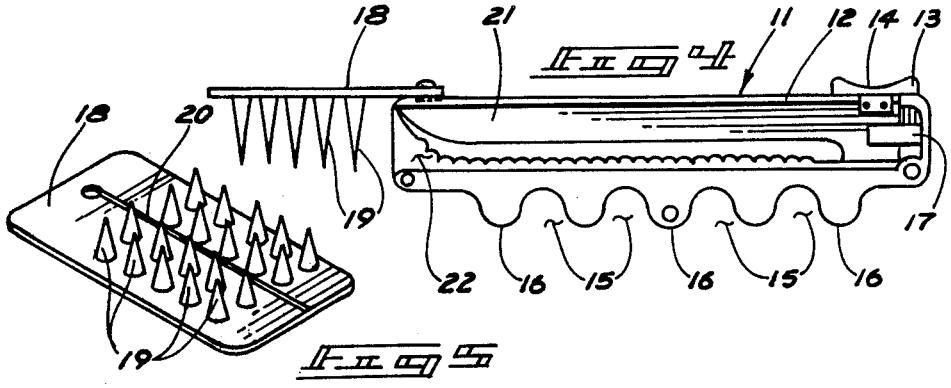
Fig 4
Fig 5

RECIPROCATING KNIFE APPARATUS

BACKGROUND OF THE INVENTION

1. Field of the Invention

The field of invention relates to cutting implements, and more particularly pertains to a new and improved cutting implement for use by individuals having only the use of a single arm.

2. Description of the Prior Art

The use of reciprocating knives for cutting operations is well known in the prior art. These knives are utilized for a variety of applications in varying environments. Individuals suffering from loss of an arm and having use of a single arm are at a disadvantage when cutting food and the like during a meal. Food in this situation will tend to squirm and reposition about a support surface, such as a plate, wherein the cutting operation for single armed individuals becomes very awkward.

Cutting implements of the prior art have been formed in a variety of configurations. For example, U.S. Pat. No. 1,997,768 to Dreverhoff sets forth the use of a mechanical razor that may be manually manipulated to slide a movable blade past a plurality of fixed teeth in a razor operation wherein the razor may be manipulated by a single hand.

U.S. Pat. No. 2,763,926 to Pate sets forth a cutting device of a generally "L" shaped configuration provided with a retractable trigger to manually manipulate and slide a movable blade between a plurality of spaced anvils.

U.S. Pat. No. 3,316,363 to Raper sets forth an electrically operated knife provided with a plurality of sliding blades to effect a cutting operation.

U.S. Pat. No. 3,376,640 to Kramer sets forth a manipulatable and reciprocatable knife with an overlying bifurcated fork whose tines are oriented orthogonally to the blade. The Kramer knife is of utility to one of limited limb capacity, but is limited in ability to maintain an article of food stationary with respect to the reciprocating knife blade.

U.S. Pat. No. 4,020,549 to Edwards sets forth a mechanical operable comb with a series of movable blades secured to a slide that are manipulatable relative to fixed teeth or anvils to effect a cutting operation.

As such, it may be appreciated that there is a continuing need for a new and improved reciprocating knife apparatus which addresses both the problems of effectiveness and convenience in a one-armed cutting operation, and in this respect, the present invention substantially fulfills this need.

SUMMARY OF THE INVENTION

In view of the foregoing disadvantages inherent in the known types of reciprocating knives now present in the prior art, the present invention provides an reciprocating knife wherein the same may be compactly stored within an associated case when not in use and may be further extended and reciprocated easily and efficiently during periods of cutting including a matrix of extending teeth to maintain an article being cut stationary relative to a reciprocating knife blade. As such, the general purpose of the present invention, which will be described subsequently in greater detail, is to provide a new and improved reciprocating knife which has all the advantages of the prior art reciprocating knives and none of the disadvantages.

To attain this, the present invention comprises a reciprocating knife apparatus wherein a knife blade may be compactly folded and stored withing an associated case during periods of non-use and telescoped outwardly and thereafter reciprocated during periods of use with an overlying flange provided with a matrix of teeth extending generally parallel to the knife blade to maintain an article of food stationary relative to the knife blade during the cutting operation.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved reciprocating knife which has all the advantages of the prior art reciprocating knives and none of the disadvantages.

It is another object of the present invention to provide a new and improved reciprocating knife which may be easily and efficiently manufactured and marketed.

It is a further object of the present invention to provide a new and improved reciprocating knife which is of a durable and reliable construction.

An even further object of the present invention is to provide a new and improved reciprocating knife which is susceptible of a low cost of manufacture with regard to both materials and labor, and which accordingly is then susceptible of low prices of sale to the consuming public, thereby making such reciprocating knives economically available to the buying public.

Still yet another object of the present invention is to provide a new and improved reciprocating knife which provides in the apparatuses and methods of the prior art some of the advantages thereof, while simultaneously overcoming some of the disadvantages normally associated therewith.

Still another object of the present invention is to provide a new and improved reciprocating knife wherein the same is provided with a matrix of teeth to maintain an article stationary relative to a reciprocating knife that may be manually manipulated by a one-armed individual.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention with the knife blade in a retracted position.

FIG. 2 is an isometric illustration of the instant invention with the knife blade in an extended position further illustrating cutaway portions to illustrate internal portions of the invention.

FIG. 3 is an orthographic sectional view of the instant invention taken in elevation illustrating the various components, their configuration, and relationship.

FIG. 4 is a cutaway view of the instant invention illustrating the knife blade in a retracted position.

FIG. 5 is an isometric illustration of the flange and associated extending teeth of the instant invention.

DESCRIPTION OF THE PREFERRED EMBODIMENT

With reference now to the drawings, and in particular to FIGS. 1 to 5 thereof, a new and improved reciprocating knife embodying the principles and concepts of the present invention and generally designated by the reference numeral 10 will be described.

More specifically, it will be noted that the reciprocating apparatus 10 essentially comprises an elongate case 11 formed with planar sides and an orthogonal top surface formed with an included slot 12 through which a slider 13 is manually and reciprocatably manipulatable. The slider 13 is formed with a ribbed concave recess 14 for ease of manipulation by a user.

The bottom surface of the case 11 is formed with a series of finger recesses 15 between projecting ribs 16 to provide a finger gripping surface to create an enhanced grasping organization for a user. The slider 13 is fixedly secured to a serrated knife blade 21 that is slidably mounted within an interior chamber 22 of the case 11.

By mere grasping of the case 11, a user upon manipulation of the slider 13 by a thumb may readily reciprocate the knife blade 21 relative to the case 11.

Positioned interiorly and to a rearward surface of the case 11 are a pair of leaf spring fingers 17 for securement of the blade 21 in a retracted position, as illustrated in FIG. 4, to prevent undesirable extension of the knife blade 21.

Secured integrally to a forward topmost portion of the case 11 in front of the slot 12, is a projecting flange 18 formed with a matrix of downwardly projecting teeth 19 projecting generally parallel to the sides and edge of the knife blade 21 for securement of an item, such as an article of food, to be severed. The teeth 10 project somewhat below the cutting edge of knife blade 21 to insure grasping of the article to be cut prior to commencement of the cutting operation. As illustrated in FIG. 5, a central spacing 20 is formed medially of the matrix of teeth 19 to allow reciprocation of the knife blade 21 therethrough.

To utilize the instant invention, one merely extends the knife blade 21 from a retracted position, as illustrated in FIG. 1, to an extended position, as illustrated in FIG. 2, in withdrawal of the knife blade 21 for securement by the leaf spring fingers 17. The teeth 19 are then imposed onto the article to be severed whereupon a user merely reciprocates the knife 21 by the slide 13 until the severing operation is complete whereupon the knife blade 21 may be retracted within the case 11 and the knife may be inserted within a sheath (not shown) for securement of same until subsequent use is desired.

Further it should be noted that the outwardly extending flange extends generally parallel to the upper surface of the case containing said slot in order to properly orient the teeth orthogonally to said flange and generally parallel to the sides of the knife to properly engage an article to be cut.

The manner of usage and operation of the present invention should be apparent from the above description and accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A reciprocating knife comprising a knife blade and a case means for securing said knife blade from a first retracted position wherein said knife blade is completely retracted within said case to a second extended position enabling reciprocation of said knife blade by manually manipulatable reciprocation means, and a flange extending outwardly and secured integrally to an upper forwardmost portion of said case, and said flange including a plurality of teeth extending downwardly from said flange to engage an article to be severed, and wherein said flange projects in a plane generally parallel to an upper surface of said case wherein said upper surface further includes a slot slidably containing said reciprocation means. and wherein said reciprocation means includes a slider formed with a concave ribbed recess for manual engagement to enable reciprocation of said knife blade, and wherein said teeth extend orthogonally downwardly relative to said flange to position below a cutting edge of said knife blade, and wherein a plurality of spring biased fingers are secured interiorly of said case and maintained at a rearward portion of said knife when said knife is in said first retracted position to engage said knife blade, and maintain said knife blade, in said first retracted position, and wherein said case includes a series of ribs along a lower face of said knife to enhance manual grasping of said case, and where said plurality of teeth include a matrix of teeth formed with a spacing medially thereof for accepting said knife blade to reciprocate between said teeth.

* * * * *